United States Patent [19]

Nash

[11] Patent Number: 4,926,790

[45] Date of Patent: May 22, 1990

[54] AUGER UNIT

[75] Inventor: Thomas W. Nash, Sodus, N.Y.

[73] Assignee: Xerox Corporation, Stamford, Conn.

[21] Appl. No.: 247,566

[22] Filed: Sep. 22, 1988

[51] Int. Cl.[5] ..... G03G 15/09

[52] U.S. Cl. ..... 118/653; 118/658; 355/251; 355/260

[58] Field of Search ..... 118/653, 656, 657, 658; 355/298, 245, 251, 252, 253, 260

[56] References Cited

U.S. PATENT DOCUMENTS

| | | | |
|---|---|---|---|
| 4,054,381 | 10/1977 | Bernhard | 355/298 X |
| 4,103,353 | 7/1978 | Dougherty | 366/81 |
| 4,213,710 | 7/1980 | Hold et al. | 366/81 |
| 4,376,578 | 3/1983 | Tanaka et al. | 355/269 X |
| 4,422,750 | 12/1983 | Kawata | 118/657 X |
| 4,593,997 | 6/1986 | Fox et al. | 355/15 |

FOREIGN PATENT DOCUMENTS

| | | | |
|---|---|---|---|
| 3120724 | 2/1982 | Fed. Rep. of Germany | 118/653 |
| 0095374 | 6/1983 | Japan | 355/260 |

*Primary Examiner*—A. T. Grimley
*Assistant Examiner*—Robert Beatty
*Attorney, Agent, or Firm*—H. Fleischer; J. E. Beck; R. Zibelli

[57] ABSTRACT

An apparatus which transports and mixes developer material in the chamber of a developer housing. An auger advances a portion of the developer material from one end to the other end of the housing. The auger has an expansion chamber extending over a portion of the chamber through which at least a portion of the developer material flows. The expansion chamber increases the mixing of the developer material and the triboelectric charge of the toner particles.

6 Claims, 3 Drawing Sheets

AUGER UNIT

This invention relates generally to an electrophotographic printing machine, and more particularly concerns an apparatus for developing an electrostatic latent image recorded on a photoconductive member used in a printing machine.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. This forms a powder image on the photoconductive member which is subsequently transferred to a copy sheet and permanently affixed thereto in image configuration.

Typically, the developer material comprises toner particles adhering triboelectrically to magnetic carrier granules. This two component mixture is brought into contact with the photoconductive surface. The toner particles are attracted from the carrier granules to the latent image. It is clear that the developer material is a critical component of the printing machine. In order to achieve high quality development, a developer housing must provide an atmosphere for both good inmixing and admixing. These mixing phenomenons, though apparently related, can be quite independent. The developer housing must therefor provide independent mechanisms for both of them. An auger system of sufficient length and velocity provides an effective means for achieving inmixing. However, the typical auger system does not provide a good environment for admixing.

Triboelectric charging results from a rubbing contact between objects of differing inherent triboelectric levels. During the process, one object becomes more negatively charged while the other becomes more positively charged. In a development system, the act of triboelectric charging occurs at only a relatively few locations, termed charging sites. For good admixing, new toner particles must be able to rub against the material at these charging sites. To achieve this, the incumbent toner particles must vacate the charging site long enough for this charge exchange to occur. Unfortunately, the very nature of oppositely charging materials makes migration away from these sites unnatural. To overcome this natural attraction, two conditions must be present; significant energy to dislodge the incumbent toner particles and a place for the dislodged toner particles to move. In a fully loaded auger system, neither of these conditions exist. Various types of auger systems have been devised, the following patents appear to be relevant:

U.S. Pat. No. 4,103,353; Patentee: Dougherty; Issued: July 25, 1978.

U.S. Pat. No. 4,213,710; Patentee: Hold et al.; Issued: July 22, 1980.

U.S. Pat. No. 4,593,997; Patentee: Fox et al.; Issued: June 10, 1986.

The pertinent portions of the foregoing patents may be briefly summarized as follows:

U.S. Pat. No. 4,103,353 discloses an extruder screw for advancing an expandable thermoplastic material. The extruder screw has a feed section and a metering section of constant area. A compression section has a decreasing area and a compression relief section has an increasing area.

U.S. Pat. No. 4,213,710 describes an extruder for processing thermoplastic materials. The extruder has a rotor with successive mixing and pumping sections.

U.S. Pat. No. 4,593,997 discloses an auger system for removing residual toner particles from a photoreceptor and collecting the toner particles in a receptacle. The auger system uses a segmented auger structure.

In accordance with one aspect of the present invention, there is provided an apparatus for transporting developer material. The apparatus includes an elongated member having an elongated aperture therein extending from one end to the other end thereof. The elongated member has an enlarged chamber extending over a portion thereof and connected to the aperture therein. Means, disposed in the aperture of the member, transport the developer material from one end of the aperture to the other end thereof. At least a portion of the developer material flows into the chamber and mixes thereat to increase the triboelectric charge thereon.

Pursuant to another aspect of the present invention, there is provided an apparatus for developing an electrostatic latent image used in a printing machine. The apparatus includes a housing defining a chamber having therein a supply of developer material. The developer material comprises at least carrier granules having toner particles adhering triboelectrically thereto. Means, in communication with the chamber of the housing, advance the developer material into contact with the electrostatic latent image. Elongated auger means, positioned at least partially in the supply of developer material in the chamber of the housing, mix the carrier granules and toner particles of the developer material. The auger means has an expansion chamber extending over a portion thereof with at least a portion of the developer material flowing into the chamber for greater mixing thereat to increase the triboelectric charge on the toner particles.

Still another aspect of the features of the present invention is an electrophotographic printing machine of the type having an electrostatic latent image recorded on a photoconductive member. The improved printing machine includes a housing defining a chamber having therein a supply of developer material comprising at least carrier granules having toner particles adhering triboelectrically thereto. Means, in communication with the chamber of the housing, advance developer material into contact with the electrostatic latent image. Elongated auger means, positioned at least partially in the supply of developer material in the chamber of the housing, mix the carrier granules and toner particles of the developer material. The auger means has an expansion chamber extending over a portion thereof. At least a portion of the developer material flows into the chamber for greater mixing thereat to increase the triboelectric charge on the toner particles.

Other aspects of the present invention will become apparent as the following description proceeds and upon reference to the drawings, in which.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Figure 1:
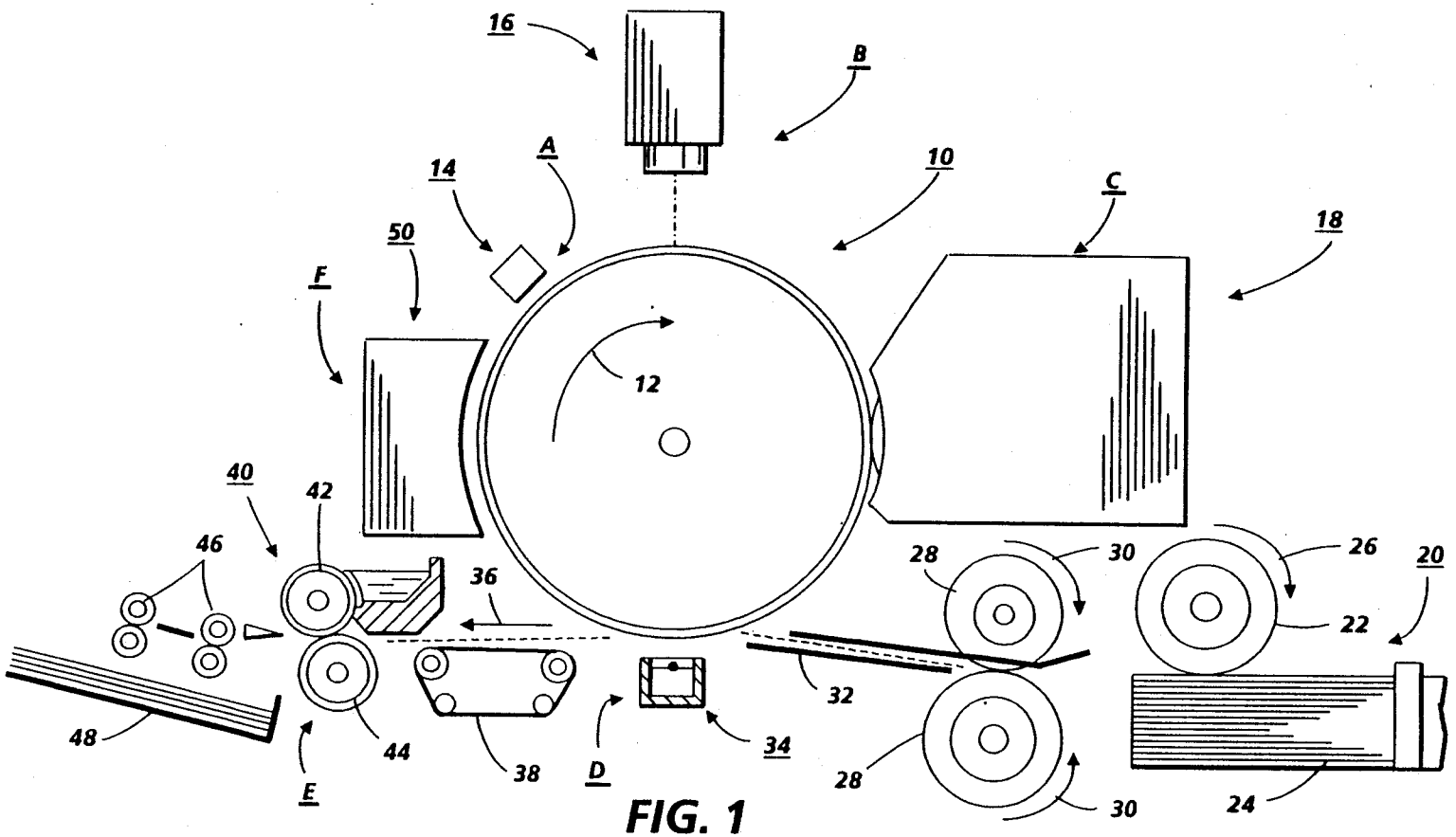
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine having the developer unit and auger system of the present invention therein. It will become evident from the following discussion that this developer unit and auger system is equally well suited for use in a wide variety of printing machines and is not necessarily limited in its application to the particular printing machine described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface adhering to a conductive substrate. Preferably, the photoconductive surface comprises a selenium alloy with the conductive substrate being an electrically grounded aluminum alloy. Drum 10 moves in the direction of arrow 12 to advance successive portions of the photoconductive surface sequentially through the various processing stations disposed about the path of movement thereof.

Initially, a portion of the photoconductive surface passes through charging station A. At charging station A, a corona generating device, indicated generally by the reference numeral 14, charges the photoconductive surface to a relatively high, substantially uniform potential.

Next, the charged portion of the photoconductive surface is advanced through imaging station B. Imaging station B includes an exposure system, indicated generally by the reference numeral 16. Exposure system 16 includes lamps which illuminate an original document positioned face down upon a transparent platen. The light rays reflected from the original document are transmitted through a lens to form a light image thereof. The light image is focused onto the charged portion of the photoconductive surface to selectively dissipate the charge thereon. This records an electrostatic latent image on the photoconductive surface which corresponds to the information contained in the original document. One skilled in the art will appreciate that in lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam.

After the electrostatic latent image is recorded on the photoconductive surface, drum 10 advances the electrostatic latent image to development station C. At development station C, a magnetic brush developer unit, indicated generally by the reference numeral 18, transports a developer material of magnetic carrier granules having toner particles adhering triboelectrically thereto closely adjacent to, or into contact with the electrostatic latent image. Toner particles are attracted from the carrier granules to the latent image forming a toner powder image. The auger system of the present invention is used in developer unit 18 to mix and triboelectrically charge the developer material. Further details of the the developer unit and auger system employed therein will be described hereinafter with reference to FIGS. 2 through 5, inclusive.

Drum 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 20. Preferably, sheet feeding apparatus 20 includes a feed roll 22 contacting the uppermost sheet of a stack of sheets 24. Feed roll 22 rotates in the direction of arrow 26 to advance the uppermost sheet into a nip defined by forwarding rollers 28. Forwarding rollers 28 rotate in the direction of arrow 30 to advance the sheet into chute 32. Chute 32 directs the advancing sheet into contact with the photoconductive surface in a timed sequence so that the toner powder image developed thereon contacts the advancing sheet at transfer station D.

Transfer station D includes a corona generating device 34 which sprays ions onto the backside of the sheet. This attracts the toner powder image from the photoconductive surface to the sheet. After transfer, the sheet continues to move in the direction of arrow 36 on conveyor 38 to advance to fusing station E.

Fusing station E includes a fuser assembly, indicated generally by the reference numeral 40, which permanently affixes the transferred toner powder image to the sheet. Preferably, fuser assembly 40 includes a heated fuser roller 42 and a back-up roller 44. The sheet passes between fuser roller 42 and back-up roller 44 with the powder image contacting fuser roller 42. In this manner, the toner powder image is permanently affixed to the sheet. After fusing, forwarding rollers 46 advance the sheet to catch tray 48 for subsequent removal from the printing machine by the operator.

After the powder image is transferred from the photoconductive surface to the copy sheet, drum 10 rotates the photoconductive surface to cleaning station F. At cleaning station F, a cleaning system, indicated generally by the reference numeral 50, removes the residual particles adhering to the photoconductive surface. In this way, the residual toner particles are removed from the photoconductive surface.

It is believed that the foregoing description is sufficient for purposes of the present invention to illustrate the general operation of an electrophotographic printing machine incorporating the features of the present invention therein.

Figure 2:
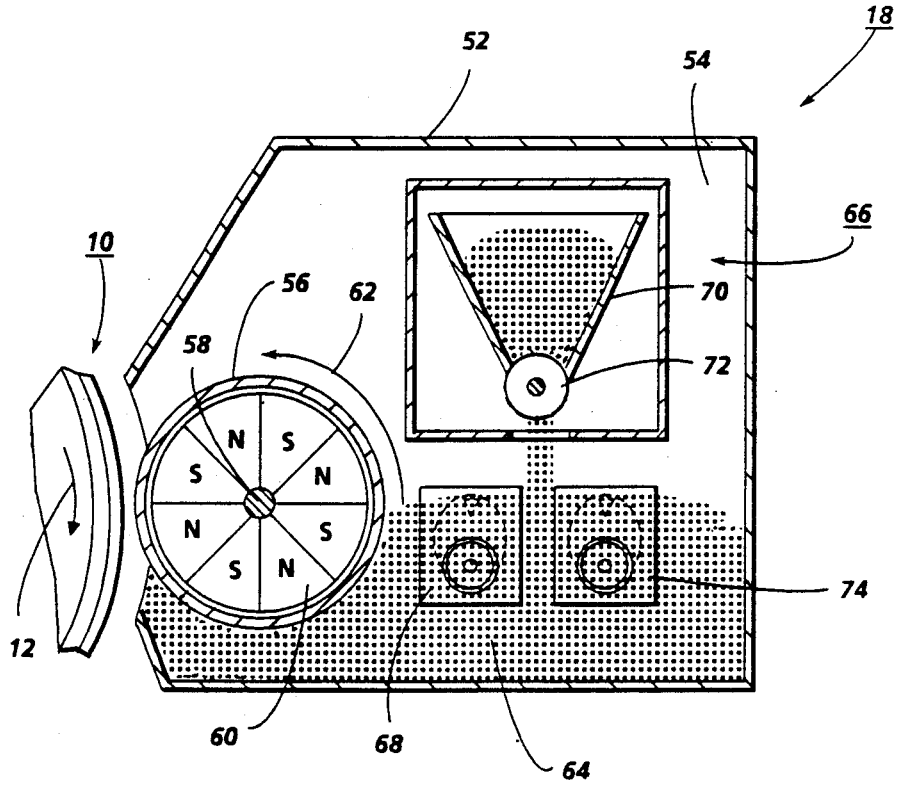
FIG. 2 is a fragmentary, elevational view of the developer unit used in the FIG. 1 printing machine.

Referring now to the specific subject matter of the present invention, FIG. 2 illustrates developer unit 18 in greater detail. Developer unit 18 includes a developer housing 52 defining a chamber 54 storing a supply of developer material including carrier granules and toner particles therein. A tubular member or sleeve 56 is mounted rotatably on shaft 58 in chamber 54 of housing 52. An elongated cylindrical magnet 60 is mounted interiorly of sleeve 56. Magnet 60 is mounted stationarily and has a plurality of magnetic poles impressed upon the circumferential surface thereof to generate a magnet field. A motor (not shown) rotates sleeve 56 in the direction of arrow 62. As sleeve 56 rotates in chamber 54 of housing 52, the developer material is attracted thereto. The rotation of sleeve 56 transports the developer material attracted thereto closely adjacent to or into contact with the photoconductive surface. In the development zone, the toner particles are attracted from the carrier granules to the latent image recorded on the photoconductive surface of drum 10. A voltage source electrically biases sleeve 56 to a suitable polarity and magnitude so that the toner particles are deposited on the latent image. Preferably, sleeve 56 is made from aluminum with magnet 60 being made from barium ferrite.

A supply of developer material 64 is stored in chamber 54 of housing 52. Sleeve 56 is mounted in chamber 54 of housing 52 with a portion thereof extending outwardly through an opening in housing 52 so that the developer material is readily advanced, during the rotation of sleeve 56 in the direction of arrow 62, to the latent image recorded on the photoconductive surface of drum 10. As the electrophotographic printing machine is used, toner particles are depleted therefrom and must be replenished. A dispensing unit, indicated generally by the reference numeral 66, dispenses toner particles into developer material 64. Dispensing unit 66 includes an open ended hopper 70 having a foam roller 72 positioned in the open end thereof. A supply of toner particles is stored in hopper 70. As roller 72 rotates, toner particles are discharged from hopper 70 to developer material 64 in chamber 54 of housing 52. The auger system of the present invention mixes the toner particles with the developer material to achieve the requisite triboelectric charge. The auger system includes auger units 68 and 74. Auger units 68 and 74 are substantially identical to one another. The only distinction between the auger units is that auger unit 68 rotates clockwise and auger unit 74 rotates counter clockwise. In this way the developer material is advanced by each auger unit in opposite directions from one end thereof to the other end thereof. Auger unit 68 will be described hereinafter in greater detail with reference to FIGS. 3 through 5, inclusive.

Figure 3:
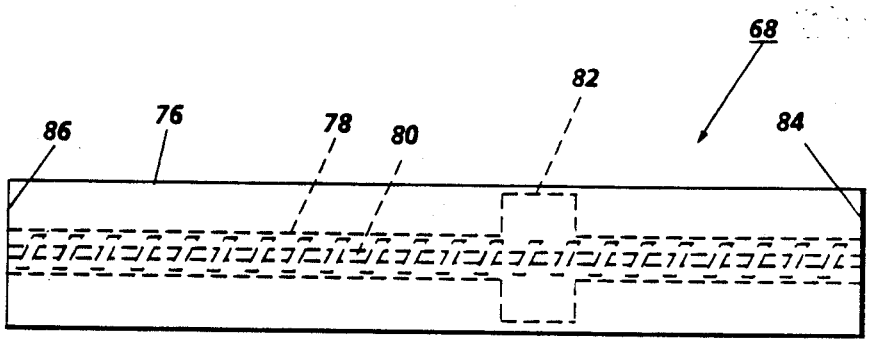
FIG. 3 is a schematic plan view of one of the auger systems used in the FIG. 2 developer unit.
Figure 4:
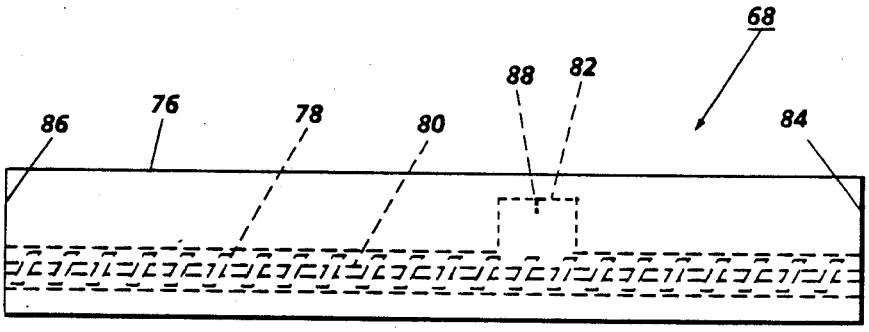
FIG. 4 is a schematic elevational view of the FIG. 3 auger system.
Figure 5:
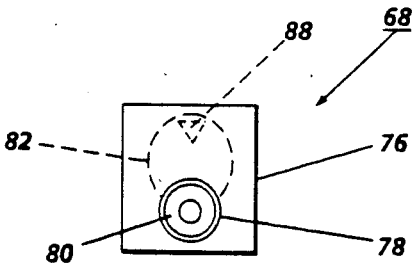
FIG. 5 is a schematic side view of the FIG. 3 auger system.

Referring now to FIGS. 3 through 5, inclusive, there is shown auger unit 68 in greater detail. As depicted in the FIG. 3 plan view, auger unit 68 includes an elongated rectangular housing 76 having a substantially elongated cylindrical aperture or bore 78 extending from one end to the other end thereof. A rotor 80 is mounted in bore 78. The rotor has a helical thread or groove wound about the exterior circumferential surface thereof. Alternatively, the rotor may be made from a shaft having spaced, inclined fins mounted thereon. In either case, as the rotor rotates, it transports the developer material from one end of housing 76 to the other end thereof. A motor (not shown) rotates rotor 80 so as to advance the developer material. An expansion chamber 82 extends outwardly from both sides of bore 80 of housing 76. The expansion chamber is located intermediate the ends of housing 76. Developer material is received at end 84 of housing 76 and discharged at end 86 thereof. As the developer material is advanced from end 84 of housing 76 to end 86, at least a portion of the developer material flows into expansion chamber 82. The bore 78 of housing 76 provides inmixing of the developer material while the expansion chamber 82 provides admixing of the developer material.

FIG. 4 shows an elevational view of auger unit 68 with expansion chamber 82 extending upwardly from an intermediate location along the length of bore 78. Rotor 80 may have lifters attached to the fins thereof for inducing lateral forces on the developer material to facilitate the upward flow of the developer material into expansion chamber 82 from bore 78.

A side elevational view of auger unit 68 is shown in FIG. 5. As illustrated thereat, a block 88 may be secured to the uppermost portion of the interior surface of expansion chamber 82. By way of example, block 88 may be triangularly shaped. As the developer material flows through expansion chamber 82, block 88 introduces a jarring action which promotes mixing and rubbing contact between the toner particles and carrier granules of the developer material. In this way, the developer material is further mixed so as to increase the triboelectric charge thereon.

In recapitulation, the auger unit of the present invention is used in a developer unit to improve admixing and inmixing of the developer material so at to increase the triboelectric charge thereon. The auger unit has a rotor mounted in a bore of a housing. An expansion chamber is provided intermediate the ends of the housing. The expansion chamber is connected to the bore. Inmixing of the developer material is achieved by the rotor advancing the developer material along the bore of the housing from one end thereof to the other end. The advancing developer material also flows into expansion chamber to improve admixing.

It is, therefore, apparent that there has been provided, in accordance with the present invention, an auger unit for use in a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

I claim:

1. An apparatus for developing an electrostatic latent image used in a printing machine, including:

a housing defining a chamber having therein a supply of developer material comprising at least carrier granules having toner particles adhering triboelectrically thereto;

means, in communication with the chamber of said housing, for advancing developer material into contact with the electrostatic latent image; and an elongated member having an elongated aperture therein extending from one end of said member to the other end thereof, said elongated member being positioned at least partially in the supply of developer material in the chamber of said housing and having an expansion chamber connected to the aperture and extending over a portion of the aperture, and means, disposed in the aperture of said member, for transporting the developer material from one end of the aperture to the other end thereof with at least a portion of the developer material flowing through the expansion chamber for greater mixing thereat to increase the triboelectric charge on the toner particles being transported from one end of the aperture to the other end thereof.

2. An apparatus according to claim 1, further including means for disturbing the developer material flowing into the chamber of said elongated member.

3. An apparatus according to claim 2, wherein said transporting means includes an auger mounted rotatably in the apertture of said member.

4. An apparatus according to claim 3, wherein the aperture in said elongated member is cylindrical.

5. An apparatus according to claim 4, wherein the chamber extends outwardly from the cylindrical aperture in said elongated member.

6. An apparatus according to claim 5, wherein said disturbing means includes a protrusion extending outwardly from a wall of the chamber of said member.

* * * * *